US007137442B2

(12) United States Patent
Kawahara et al.

(10) Patent No.: US 7,137,442 B2
(45) Date of Patent: Nov. 21, 2006

(54) VAPOR CHAMBER

(75) Inventors: Youji Kawahara, Tokyo (JP); Noriyuki Takada, Tokyo (JP); Masataka Mochizuki, Tokyo (JP); Koichi Mashiko, Tokyo (JP); Yuji Saito, Tokyo (JP); Tetsuya Kobayashi, Tokyo (JP); Akihiro Takamiya, Tokyo (JP); Tadashi Sano, Kanagawa (JP); Fumitoshi Kiyooka, Kanagawa (JP); Hiroaki Agata, Kanagawa (JP)

(73) Assignees: Fujikura Ltd., Tokyo (JP); International Business Machines Corporation, Armonk, NY (US)

( * ) Notice: Subject to any disclaimer, the term of this patent is extended or adjusted under 35 U.S.C. 154(b) by 0 days.

(21) Appl. No.: 11/016,938

(22) Filed: Dec. 21, 2004

(65) Prior Publication Data

US 2005/0155745 A1 Jul. 21, 2005

(30) Foreign Application Priority Data

Dec. 22, 2003 (JP) ..... 2003-425494

(51) Int. Cl.
*F28F 15/04* (2006.01)

(52) U.S. Cl. ..... 165/104.26; 165/104.21

(58) Field of Classification Search ..... 165/104.26, 165/104.21; 29/890.032; 361/700
See application file for complete search history.

(56) References Cited

U.S. PATENT DOCUMENTS

| | | | | |
|---|---|---|---|---|
| 3,613,778 | A * | 10/1971 | Feldman, Jr. | 165/104.26 |
| 4,043,387 | A * | 8/1977 | Lamp | 165/104.27 |
| 4,116,266 | A * | 9/1978 | Sawata et al. | 165/104.26 |
| 4,274,479 | A * | 6/1981 | Eastman | 165/104.26 |
| 4,489,777 | A * | 12/1984 | Del Bagno et al. | 165/104.26 |
| 6,082,443 | A * | 7/2000 | Yamamoto et al. | 165/104.26 |
| 6,460,612 | B1 * | 10/2002 | Sehmbey et al. | 165/96 |
| 2002/0124995 | A1 * | 9/2002 | Moon et al. | 165/104.11 |
| 2003/0141045 | A1 * | 7/2003 | Oh et al. | 165/104.26 |
| 2005/0126761 | A1 * | 6/2005 | Chang et al. | 165/104.33 |

FOREIGN PATENT DOCUMENTS

| | | |
|---|---|---|
| JP | 2794154 B2 | 6/1998 |
| JP | 2000-49466 A | 2/2000 |
| JP | 3067399 B2 | 5/2000 |

* cited by examiner

*Primary Examiner*—Teresa J. Walberg
(74) *Attorney, Agent, or Firm*—Sughrue Mion, PLLC

(57) ABSTRACT

A vapor chamber, in which a condensable fluid, which evaporates and condenses depending on a state of input and radiation of a heat, is encapsulated in a hollow and flat sealed receptacle as a liquid phase working fluid; and in which the wick for creating the capillary pressure by moistening by the working fluid is arranged in said sealed receptacle, comprising: a wick for creating a great capillary pressure by being moistened by said working fluid, which is arranged on the evaporating part side where the heat is input from outside; and a wick having a small flow resistance against the moistening working fluid, which is arranged on the condensing part side where the heat is radiated to outside.

20 Claims, 6 Drawing Sheets

FIG.3

| | WICK OF EVAPORATING PART | WICK OF HEAT INSULATING PART AND CONDENSING PART |
|---|---|---|
| EMBODIMENT 1 | SINTERED SMALL COPPER PARTICLES (SIZE : 25–100 μm) | COARSE MESH (100–MESH) |
| EMBODIMENT 2 | SINTERED SMALL COPPER PARTICLES (SIZE : 25–100 μm) | SINTERED LARGE COPPER PARTICLES (SIZE : 75–250 μm) |
| EMBODIMENT 3 | FINE MESH (200–MESH) | COARSE MESH (100–MESH) |
| EMBODIMENT 4 | SINTERED SMALL COPPER PARTICLES (SIZE : 25–100 μm) | SLIT(0.1mm WIDTH x 0.1mm DEPTH) |
| EMBODIMENT 5 | FINE MESH (200–MESH) | SLIT(0.1mm WIDTH x 0.1mm DEPTH) |

VAPOR CHAMBER

The present invention claims the benefit of Japanese Patent Application No. 2003-425494, filed on Dec. 22, 2003 in the Japanese Patent Office, the disclosure of which is incorporated herein by reference in its entirety.

BACKGROUND OF THE INVENTION

1. Field of the Invention

The present invention relates to a heat pipe for transporting heat as latent heat of a working fluid or a condensable fluid, and relates especially to a vapor chamber in which a sealed receptacle is shaped into a tabular shape, i.e., a flat rectangular plate, and which is constructed to create a pumping force for refluxing a liquid phase working fluid to a portion where it evaporates, by means of a capillary pressure.

2. Discussion of the Related Art

In the customary way, a heat pipe for transporting heat in the form of latent heat of a working fluid is well known in the prior art. The heat pipe of this kind is a heat conducting element encapsulating a condensable fluid such as water in a sealed receptacle (container) after evacuating an air therefrom. Such a heat pipe is constructed to transport the heat as latent heat of a working fluid by evaporating the working fluid, with the heat input from outside, and by condensing a vapor by radiating the heat after the vapor flows to a condensing part of a low temperature and a low pressure. Accordingly, since the heat is transported in the form of latent heat of the working fluid, the heat pipe has more than ten times to several hundred times of heat transporting capacity in comparison with that of copper which is known to have the highest heat conductivity.

According to a heat pipe of this kind, the heat is transported by means of flowing the evaporated vapor phase working fluid to a condensing part in a low temperature and low pressure side, and, after the heat transportation, the condensed liquid phase working fluid is refluxed to the evaporating part (i.e., a heat inputting part) by the capillary pressure of a wick.

The wick is, in short, a member for creating a capillary pressure, and therefore, it is preferable that it be excellent in hydrophilicity with the working fluid, and it is preferable that its effective radius of a capillary tube as small as possible at a meniscus formed on a liquid surface of the liquid phase working fluid. Accordingly, a porous sintered compound or a bundle of extremely thin wires generally is employed as a wick. Among those wick members according to the prior art, the porous sintered compound may create great capillary pressure (i.e., a pumping force to the liquid phase working fluid) because the opening dimensions of its cavities are smaller than that of other wicks. Also, the porous sintered compound may be formed into a sheet shape so that it may be employed easily on a flat plate type heat pipe or the like, called a vapor chamber, which has been attracting attention in recent days. Accordingly, the porous sintered compound is a preferable wick material in light of those points of view.

The heat transporting characteristics of the heat pipe including the vapor chamber is thus improved as a result of an improvement of a wick material and so on, and miniaturization is also attempted in connection with this. At the same time, the cooling of a personal computer, a server, or a portable electronics device, which are enhanced in compactness and capacity, has been becoming a problem in recent days. The heat pipe has been garnering the attention as a means for solving this problem, and it has been employed more frequently. Examples of employing such downsized and thin-shaped heat pipe are disclosed in Japanese Patent Nos. 2,794,154 and 3,067,399, and Japanese Patent Laid-Open No. 2000-49266.

As described above, it is possible to increase the capillary pressure for refluxing the liquid phase working fluid if a porous body is employed as a wick to be built into the heat pipe. This is advantageous for downsizing the vapor chamber. However, a flow path is formed by the cavity created among the fine powders as the material of a porous body, so that the flow cross-sectional area of the flow path has to be small and as intricate as a maze. Therefore, it is possible to enhance the capillary pressure which functions as the pumping force for refluxing the liquid phase working fluid to a portion where it evaporates. However, on the other hand, there is a disadvantage because the flow resistance against the liquid phase working fluid is relatively high. For this reason, if the input amount of heat from outside increases suddenly and drastically, for example, the wick may dry out due to a shortage of the liquid phase working fluid to be fed to the portion where the evaporation of the working fluid takes place.

SUMMARY OF THE INVENTION

An object of the present invention is the further improvement of the heat transport capacity of a vapor chamber by promoting a reflux of a liquid phase working fluid to an evaporating part.

In order to achieve the above-mentioned object, according to the present invention, a wick in an evaporating part of a vapor chamber and a wick in a condensing part of the vapor chamber are structurally different so that capillary pressure is actively created in the evaporating part, and a smooth flow of the liquid phase working fluid is created in the condensing part. Specifically, according to the present invention, there is provided a hollow, sealed vapor chamber; in which a condensable fluid, which evaporates and condenses depending on a state of input and radiation of a heat, is encapsulated in as a liquid phase working fluid. The chamber comprises an evaporating part and a condensing part, wherein external heat enters the chamber through the evaporating part and internal heat is radiated to the external environment from the condensing part. A first wick, which is moistened by the fluid, thus creating a capillary pressure, is disposed within the evaporating part, and a second wick is disposed within the condensing part.

The first wick can be made of a porous sintered compound comprising sintered particles or of a mesh. The second wick can be made of a of porous sintered compound comprising larger particles than those of the porous sintered compound of the first wick, a mesh, coarser than the mesh of the first wick, or thin grooves.

According to the present invention, therefore, greater capillary pressure is created in the first wick, in comparison with that created in the second wick, and the flow resistance in the second wick smaller than that in the first wick. Accordingly, the working fluid is evaporated by the heat input into the evaporating part from the external environment. The capillary pressure at a meniscus of the fluid formed on a surface of the first wick is high(i.e., a pumping force is great), and the flow resistance in the second wick in the condensing part is small. Therefore, the liquid phase working fluid refluxes to the evaporating part promptly and efficiently. As a result, there is a smooth circulation of the fluid in the vapor chamber, so that the heat transporting characteristics are be improved.

BRIEF DESCRIPTION OF THE DRAWINGS

These and other features, aspects, and advantages of the present invention will become better understood with reference to the following description, amended claims, and accompanying drawings, which should not be read to limit the invention in any way, in which:

FIG. 3 is a table for explaining a wick of the vapor chamber shown in FIG. 1;

DETAILED DESCRIPTION OF THE INVENTION

Figure 1:
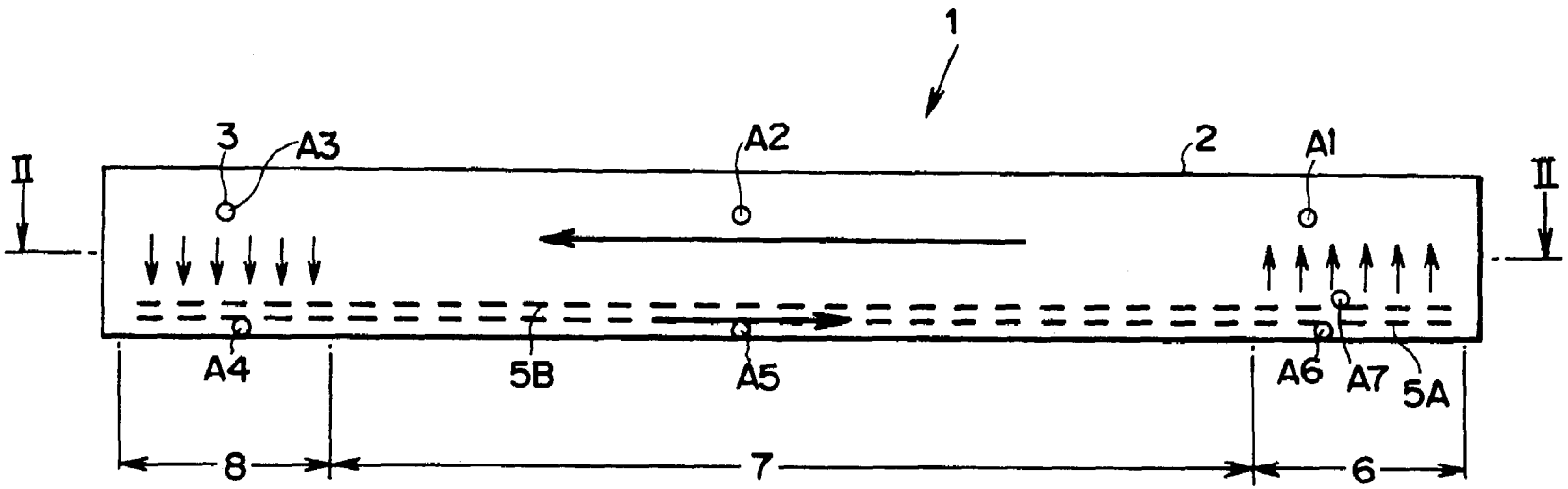
FIG. 1 is a schematic view showing one specific example of a vapor chamber according to the present invention.
Figure 2:
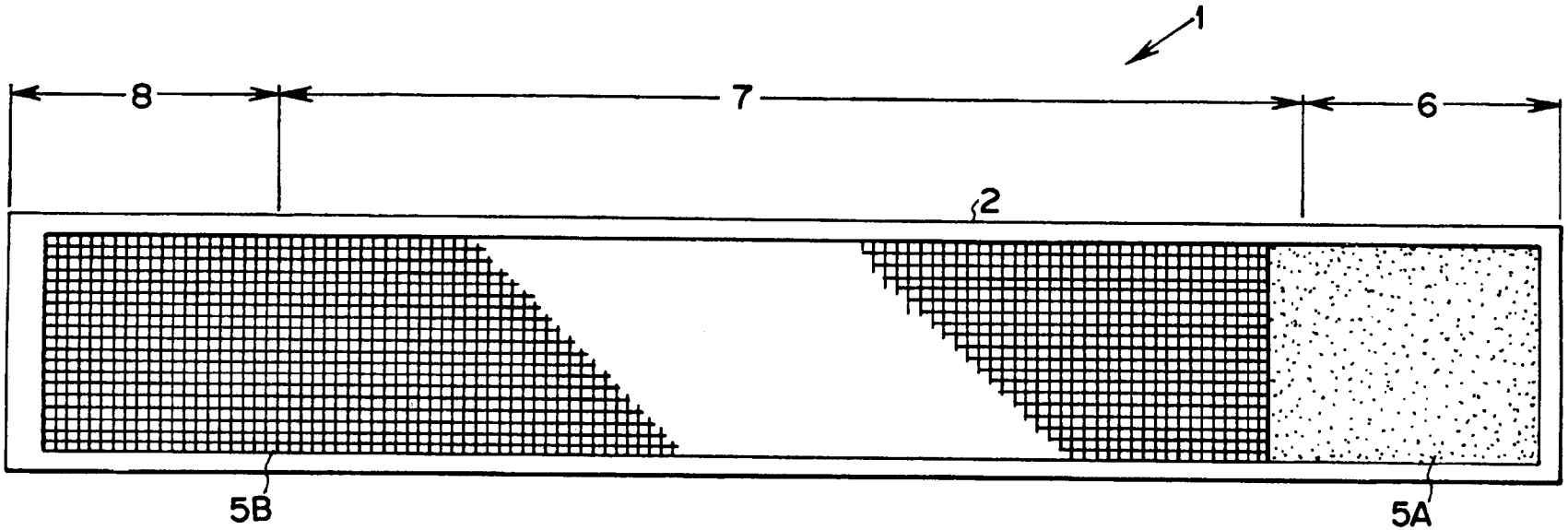
FIG. 2 is a cross-sectional perspective view showing II—II line in FIG. 1.

Here will be described an exemplary embodiment of the present invention. FIG. 1 is a schematic view showing one specific example of a vapor chamber according to the present invention, and FIG. 2 is a cross-sectional perspective view from line 11—11 of FIG. 1. This vapor chamber 1 has a structure comprising at least two wicks, wherein a wick 5A having a large capillary pressure is arranged in an evaporating part 6, and wherein a wick 5B, having a small flow resistance against the working fluid, is arranged in a heat insulating part 7 and in a condensing part 8. In the vapor chamber 1, moreover, a condensable fluid such as water is encapsulated as a working fluid 3 in a container (i.e., a hollow sealed container) 2 sealed in an air-tight condition, from which a non-condensable gas such as air is evacuated.

Specifically, the container 2 is made of a metal, such as copper, having high heat conductivity, and is formed into a thin cuboid. Hence the upper and lower faces of the container 2 are rectangular. In the vicinity of one end portion in a longitudinal direction, an electronic part may be mounted. Consequently, heat is input to said one end portion from the outside, and this portion functions as the evaporating part 6. The end portion on the opposite side of the evaporating part 6 is constructed to radiate heat, so that the opposite end portion functions as a condensing part 8. A portion between the evaporating part 6 and the condensing part 8 is a heat insulating part 7, where the heat is not transferred between the container and the outside. For example, a heat insulating coating (not shown) can be applied to the heat insulating part 7, or an air layer (not shown) can be formed around an outer circumference of the heat insulating part 7.

Here will be described the wick 5A arranged in the evaporating part 6. When the liquid phase working fluid 3 moistens the wick 5A, a meniscus is formed on a liquid surface side, and capillary pressure inversely proportional to an effective radius of a capillary tube is created at the meniscus. The wick 5A in the evaporating part 6 has a small effective capillary tube radius. Specifically, the wick 5A is composed of a porous sintered compound made of particles (e.g., copper particles, each having a particle diameter of 25 to 100 μm) or of a netlike material (e.g., 200-mesh).

A flow path is formed in the wick 5B of the condensing part 8 and the heat insulating part 7 so as to cause the liquid phase working fluid 3 being condensed to flow and penetrate into the wick 5B. Accordingly, the wick 5B is constructed to permit a smooth flow of the liquid phase working fluid 3. Namely, a void part in the wick 5B, which functions as a flow path, is constructed to have an opening sectional area as wide as possible, or to extend as straight as possible. Specifically, the wick 5B is composed of a netlike material having a relatively coarse mesh (e.g., 100-mesh), a porous sintered compound having particles of a relatively larger diameter (e.g., copper particles each having a particle diameter of 25 to 100 μm) than those of the wick 5A, or a thin slit (e.g., 0.1 mm width×0.1 mm depth).

Wicks 5A and 5B can be used in combination. Combinations of the wicks are described in embodiments 1 through 5 of FIG. 3. Wicks 5A and 5B can be integrated if both are made of porous sintered compound. In such a case, the materials comprising individual wicks have particles of different diameters. In a case in which the wicks 5A and 5B are both made of a mesh material, on the other hand, mesh materials of different counts can be jointed to each other by twisting the strands of the mesh. Moreover, in a case in which the wick 5B in the condensing part 8 is formed of thin slits, the thin slits can be joined to the porous sintered compound or to the mesh material in the evaporating part 6. In short, the flow paths formed by any individual wicks 5A and 5B can be connected.

When heat is input from outside the container to the evaporating part 6 of a vapor chamber 1 having the above-mentioned construction, the heat is transmitted to the working fluid 3 which penetrates the wick 5A. As a result of this, the working fluid 3 evaporates. Further, since heat is radiated from the condensing part 8, the pressure in the condensing part 8 is low enough to cause the vapor of the working fluid 3 to flow to the condensing part 8. Then, the working fluid 3 condenses, and as a result, the heat is drawn to the outside of the container, and the liquefied working fluid 3 penetrates into the wick 5B.

As the meniscus in the wick 5A in the evaporating part 6 is lowered as a result of evaporation of the working fluid 3 in the wick 5A, a pumping force for drawing the working fluid 3 up by the capillary pressure, according to the effective radius of capillary tube, is created. Moreover, since the flow paths formed in each of wicks 5A and 5B are connected and are filled with the working fluid 3, the working fluid 3 is aspirated to the evaporating part 6 in accordance with said pumping force. Thus, the working fluid 3 repeats the cycle of evaporation and condensation and circulates between the evaporating part 6 and the condensing part 8, thereby transporting heat as latent heat of a working fluid 3.

According to an exemplary embodiment of the vapor chamber 1 of the present invention, the wick 5A, in the evaporating part 6, is constructed to create a high capillary pressure, and on the other hand, the wick 5B, in the condensing part 8 and the heat insulating part 7, is constructed to have a low flow resistance against the liquid phase working fluid 3. Therefore, pressure loss is reduced so as not to impede the "pumping action" in the evaporating part 5. As a result, in the aforementioned vapor chamber 1, the pumping force for refluxing the liquid phase working fluid 3 is strong, so that the heat can be transported, without causing a "drying out," by circulating the liquid phase working fluid 3 smoothly, even when the input amount of heat is large.

Figure 4:
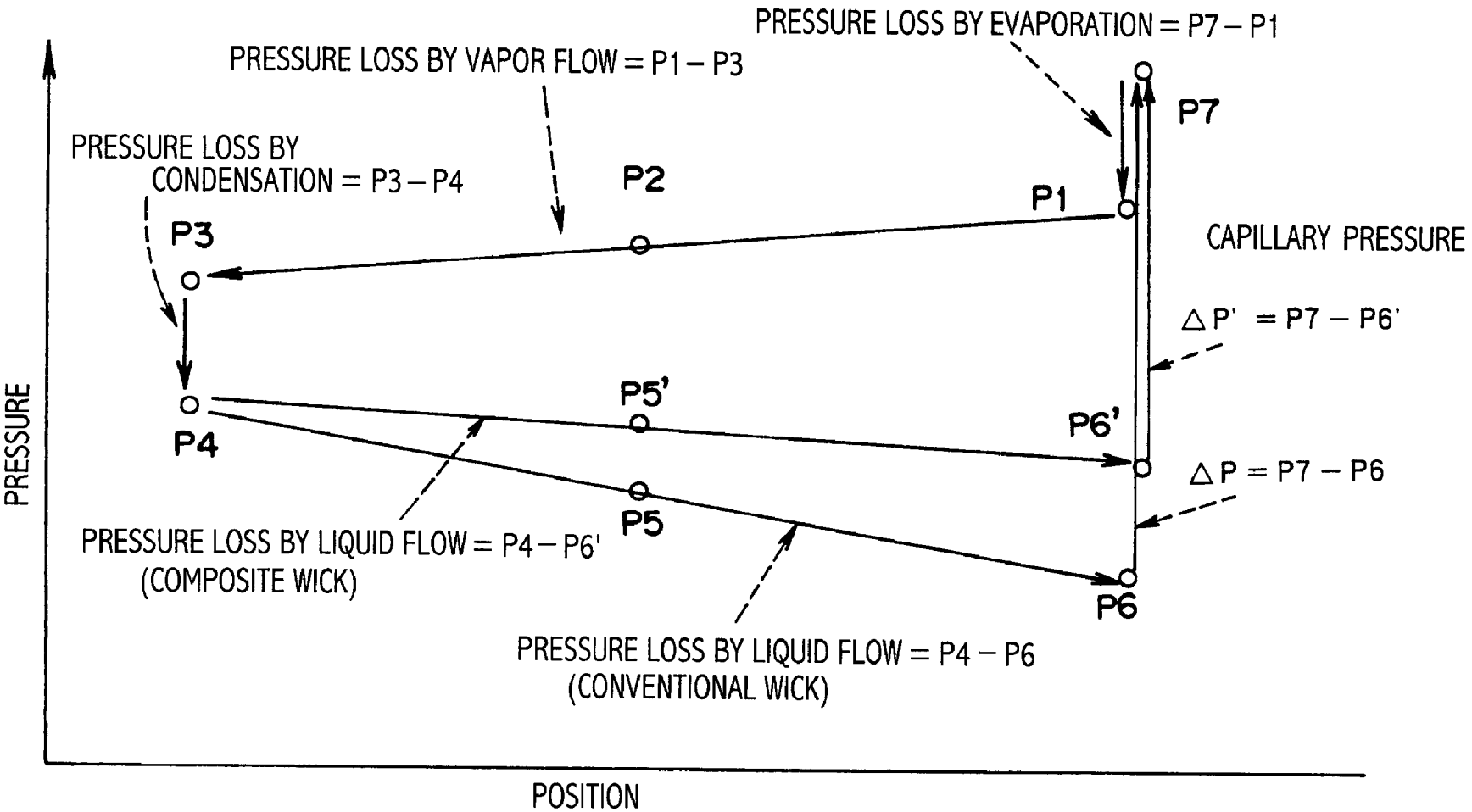
FIG. 4 is a diagram showing a pressure profile in the vapor chamber of the invention and in the prior art.

Here, a pressure profile of the aforementioned vapor chamber 1 is compared with that of a vapor chamber of the prior art, in which single wick is provided, as shown in FIG. 4. In FIG. 4, P1 to P7 indicate pressures at individual points from A1 to A7 in FIG. 1. In the prior art, there is provided a vapor chamber in which a wick similar to the wick 5A, in the evaporating part 6 of the vapor chamber 1 of the present invention, is arranged. Accordingly, a pressure P7, in accordance with the effective radius of the capillary tube; a pressure P1, at a position A1 after the pressure loss has occurred due to the evaporation; a pressure P2, at a position A2 in the middle of the vapor flow; a pressure P3 at a position A3 in the condensing part 8; and a pressure P4, at a position A4 after the occurrence of the pressure loss due to condensation, are all same in both the vapor chamber 1 of the present invention and the vapor chamber of the prior art.

In the vapor chamber 1 of the present invention, however, the wick 5B in the condensing part 8 has a low flow resistance against the liquid phase working fluid 3, so that a pressure P5', at a position A5' in the middle of the flow toward the evaporating part 6, and a pressure P6', at a position A6' in the evaporating part 6, are not changed significantly in comparison with the pressure P4 at a position A4 in the condensing part 8. In short, a negative pressure (i.e., a pressure causing an aspirating action) increases. This is expressed by ($\Delta P'$=P7−P6') in FIG. 4. According to the prior art, on the other hand, the pressure loss is large in the wick because the flow resistance is large. Consequently, the pressure at the position A6 has to be high, and the pumping force is relatively low. This is expressed by ($\Delta P'$=P7−P6) in FIG. 4.

Specifically, in the vapor chamber 1 of the present invention, it is possible to raise the pumping force for refluxing the liquid phase working fluid 3, so that the heat can be transported without causing drying out, by refluxing the liquid phase working fluid 3 sufficiently even in a case in which the input amount of heat is large.

Figure 5:
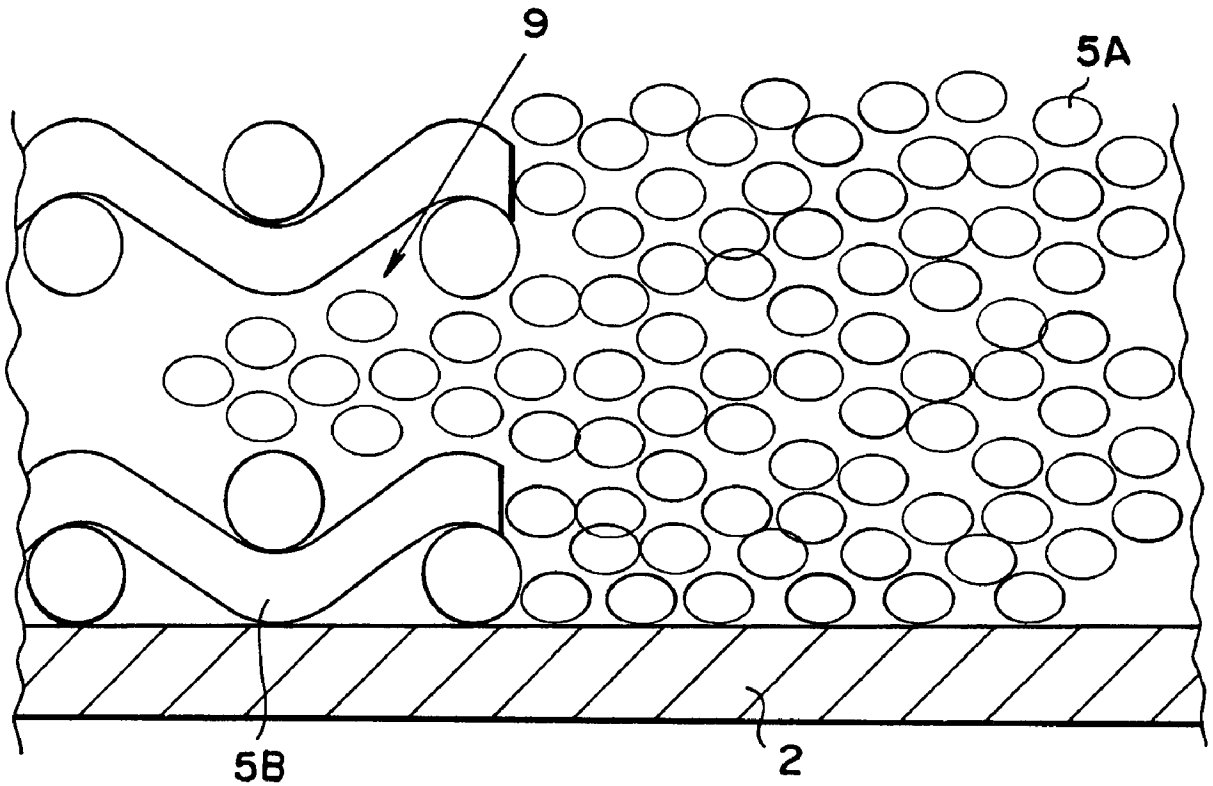
FIG. 5 is a view showing one example of a joint portion between the wicks in an evaporating part and in a condensing part according to the present invention.
Figure 6:
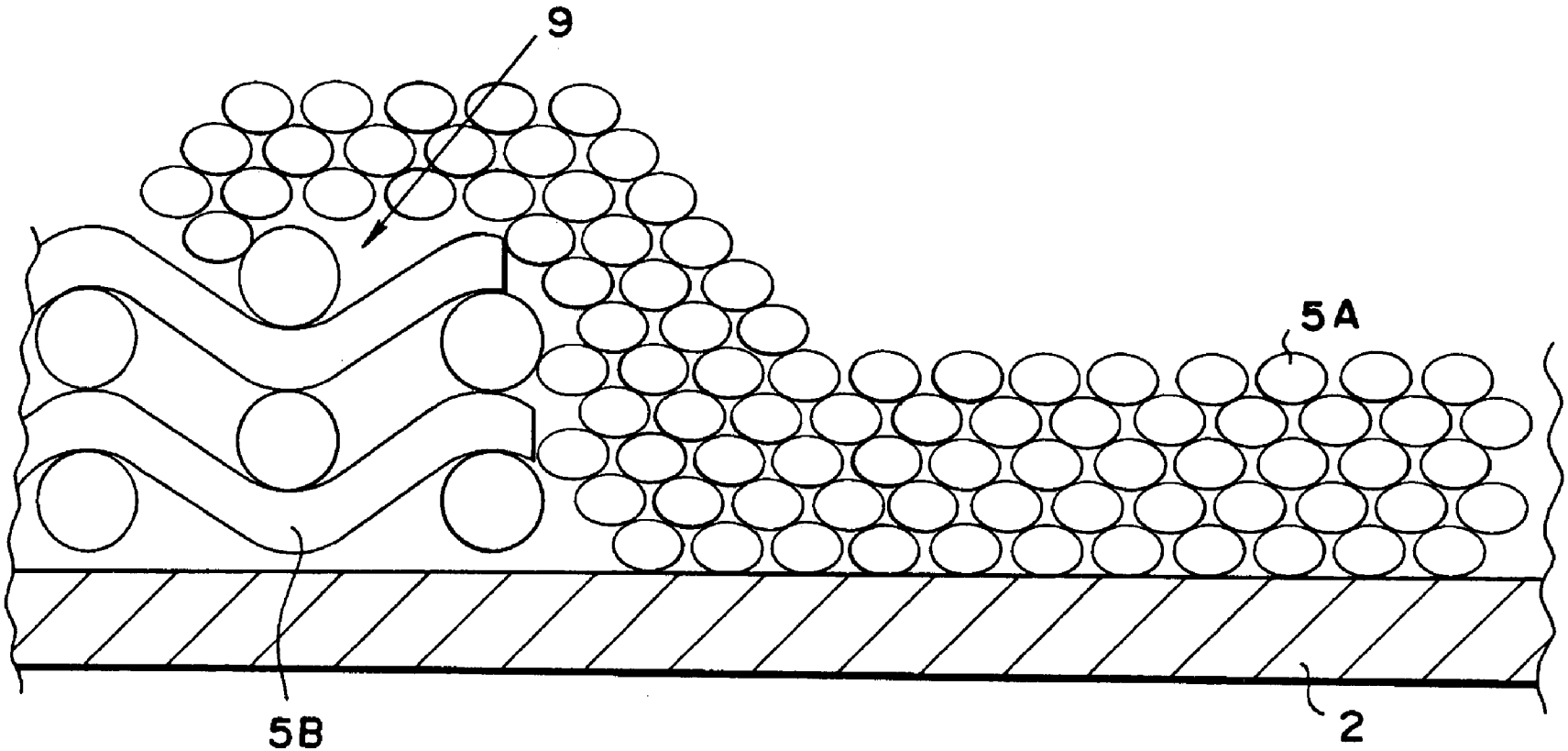
FIG. 6 is a view showing another example of the joint portion between the wicks in the evaporating part and in the condensing part according to the present invention.

The vapor chamber of the invention should not be limited to those specific examples thus far described. As shown in FIG. 5 or 6, an introducing part of the liquid phase working fluid may be constructed by stratifying the wick in the condensing part and the wick in the evaporating part in layers at a joint portion between those wicks. Specifically, as illustrated in FIG. 5, an introducing part 9, the joint portion between the heat insulating part 7 and the evaporating part 6, may be constructed by sandwiching the wick 5A made of the porous sintered compound with the wicks 5B made of the mesh material. Alternatively, as illustrated in FIG. 6, the introducing part 9 may be constructed by fitting the wick 5A made of the porous sintered compound inside of the wick 5B made of the mesh material at the joint portion between the heat insulating part 7 and the evaporating part 6. Moreover, although not especially shown, the introducing part 9 may be constructed by fitting the wick 5B made of the mesh material inside of the wick 5A made of the porous sintered compound at the joint portion between the heat insulating part 7 and the evaporating part 6. Further, the introducing part 9 may be constructed in another way as would be understood by one of skill in the art, providing that the introducing part 9 thus constructed prevents the abrupt change of capillary pressure at the joint portion between the heat insulating part 7 and the evaporating part 6, and therefore, that the liquid phase working fluid 3 flowing through the mesh part of the wick 5B is not aspirated to the evaporating part 6 side drastically. Consequently, according to the present invention, a continuity of a liquid film is improved and the liquid phase working fluid 3 refluxes efficiently to the evaporating part 6 so that efficient heat transport can be carried out.

Although the above exemplary embodiments of the present invention have been described, it will be understood by those skilled in the art that the present invention should not be limited to the described exemplary embodiments, but that various changes and modifications can be made within the spirit and scope of the present invention.

What is claimed is:

1. A vapor chamber, comprising:

a hollow, scaled chamber comprising an evaporating part and a condensing part, wherein external heat enters the chamber through the evaporating part and internal heat is radiated to the external environment from the condensing part;

a fluid disposed within the chamber;

a first wick, disposed within the evaporating part, which is moistened by the fluid; and a second wick, disposed within the condensing part;

wherein the second wick has a flow resistance against the fluid less than the flow resistance of the first wick against the fluid; and wherein an end of the first wick is connected to an end of the second wick;

wherein the first wick is a porous sintered compound;

wherein the second wick is a coarse mesh; and wherein at the connection between an end of the first wick and an end of the second wicks, portions of the porous sintered compound are layered with portions of the coarse mesh.

2. The vapor chamber according to claim 1, wherein:

the chamber further comprises a heat insulating part, disposed between the evaporating part and the condensing part, in which there is no heat transfer between the inside of the chamber and the external environment; and the second wick is disposed within the condensing part and the heat insulating part.

3. The vapor chamber according to claim 1, wherein:

the porous sintered compound comprises sintered copper particles, each having a diameter between 25 to 100 μm; and the coarse mesh is 100 mesh.

4. The vapor chamber according to claim 1, wherein:

the first wick is a first porous sintered compound comprising sintered particles; and the second wick is a second porous sintered compound comprising sintered particles of a larger diameter thin the particles comprising the first porous sintered compound.

5. The vapor chamber according to claim 1, wherein:

the first wick is a porous sintered compound; and the second wick is a plurality of thin slits.

6. The vapor chamber according to claim 1, wherein:

the first wick is a mesh; and the second wick is a porous sintered compound.

7. The vapor chamber according to claim 5, wherein:

the first wick is a 200 mesh.

8. The vapor chamber according to claim 1, wherein:

the first wick is a first mesh; and the second wick is a second mesh coarser than the first mesh.

9. The vapor chamber according to claim 8, wherein:

the first mesh is a 200 mesh; and the second mesh is a 100 mesh.

10. The vapor chamber according to claim 1, wherein:
the first wick is a mesh; and
the second wick is a plurality of thin slits.

11. The vapor chamber according to claim 10, wherein:
the first Wick is a 200 mesh.

12. A vapor chamber, comprising:
a hollow, scaled chamber comprising an evaporating part and a condensing part, wherein external heat enters the chamber through the evaporating part and internal heat is radiated to the external environment from the condensing part;
a fluid disposed within the chamber;
a first wick, disposed within the evaporating part, which is moistened by the fluid; and
a second wick, disposed within the condensing part;
wherein the second wick has a flow resistance against the fluid less than the flow resistance of the first wick against the fluid;
wherein an end of the first wick is connected to an end of the second wick;
wherein the first wick is a first porous sintered compound comprising sintered particles; and
wherein the second wick is a second porous sintered compound comprising sintered particles of a larger diameter than the particles comprising the first porous sintered compound.

13. The vapor chamber according to claim 12, wherein:
the chamber further comprises a heat insulating part, disposed between the evaporating part and the condensing part, in which there is no heat transfer between the inside of the chamber and the external environment; and
the second wick is disposed within the condensing part and the heat insulating part.

14. The vapor chamber according to claim 12, wherein:
the first wick is a porous sintered compound; and
the second wick is a plurality of thin slits.

15. The vapor chamber according to claim 14, wherein:
the first wick is a mesh; and
the second wick is a porous sintered material.

16. The vapor chamber according to claim 14, wherein:
the first wick is 200 mesh.

17. The vapor chamber according to claim 12, wherein:
the first wick is a first mesh; and
the second wick is a second mesh coarser than the first mesh.

18. The vapor chamber according to claim 17, wherein:
the first mesh is a 200 mesh; and
the second mesh is a 100 mesh.

19. The vapor chamber according to claim 12, wherein:
the first wick A is a mesh; and
the second wick is a plurality of thin slits.

20. The vapor chamber according to claim 19, wherein:
the first wick is a 200 mesh.

* * * * *

UNITED STATES PATENT AND TRADEMARK OFFICE

CERTIFICATE OF CORRECTION

PATENT NO. : 7,137,442 B2
APPLICATION NO. : 11/016938
DATED : November 21, 2006
INVENTOR(S) : Youji Kawahara et al.

It is certified that error appears in the above-identified patent and that said Letters Patent is hereby corrected as shown below:

Col. 6 line 49 delete “thin” and insert --than--.

Col. 8 line 22 delete “A” after “wick”.

Signed and Sealed this

Thirteenth Day of February, 2007

JON W. DUDAS
*Director of the United States Patent and Trademark Office*